US005971783A

United States Patent [19]

Mann

[11] Patent Number: 5,971,783

[45] Date of Patent: Oct. 26, 1999

[54] BUTTON CONNECTOR WITH SAFE FRONT

[75] Inventor: Karl Edward Mann, Farmingville, N.Y.

[73] Assignee: Northrop Grumman Corporation, Los Angeles, Calif.

[21] Appl. No.: 09/039,545

[22] Filed: Mar. 16, 1998

[51] Int. Cl.[6] ..... H01R 29/00

[52] U.S. Cl. ..... 439/188; 200/51.09

[58] Field of Search ..... 439/188; 200/51.09

[56] References Cited

U.S. PATENT DOCUMENTS

| | | | |
|---|---|---|---|
| 3,693,133 | 9/1972 | Harbonn et al. | 439/278 |
| 3,915,536 | 10/1975 | Glanz | 439/188 |
| 4,060,299 | 11/1977 | Williams | 439/289 |
| 4,066,312 | 1/1978 | Faure | 439/42 |
| 4,146,286 | 3/1979 | Jones | 439/289 |
| 4,148,536 | 4/1979 | Petropoulsos et al. | 439/188 |
| 4,227,059 | 10/1980 | Ogawa | 200/153 |
| 4,293,180 | 10/1981 | Taylor | 439/289 |
| 4,778,400 | 10/1988 | Jacobs | 439/152 |
| 4,906,205 | 3/1990 | Viles | 439/504 |
| 5,052,484 | 10/1991 | Gesta | 439/188 |
| 5,248,259 | 9/1993 | Naito et al. | 439/188 |
| 5,775,927 | 7/1998 | Wider | 439/188 |

*Primary Examiner*—Neil Abrams
*Assistant Examiner*—T C Patel
*Attorney, Agent, or Firm*—Terry J. Anderson; Karl J. Hoch, Jr.

[57] ABSTRACT

In accordance with the present invention, there is provided a connector set which is provided with first and second connectors. The first connector itself is provided with a first housing, and first and second contacts which are at least partially captured within the first housing. The first connector further includes a resilient biasing member disposed within the first housing and normally maintaining the first and second contacts in spaced relation to each other. The second connector is provided with a second housing and a third contact which is at least partially captured within the second housing. The application of pressure to the first contact by the third contact in an amount sufficient to compress the biasing member results in the electrically conductive engagement between the first and second contacts and the electrical connection of the third contact to the second contact. The removal of such pressure from the first contact results in the resilient return of the biasing member to an uncompressed state which separates the first and second contacts from each other and breaks the electrical connection between the third and second contacts.

12 Claims, 2 Drawing Sheets

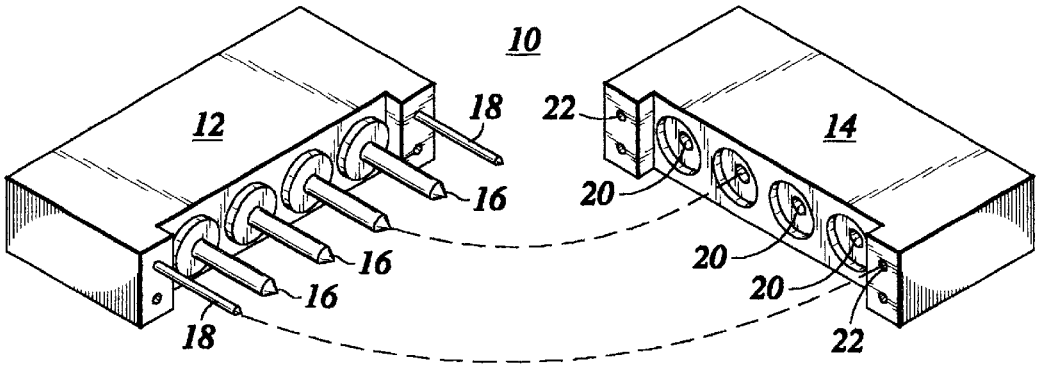
(PRIOR ART)
Fig. 1
Fig. 2
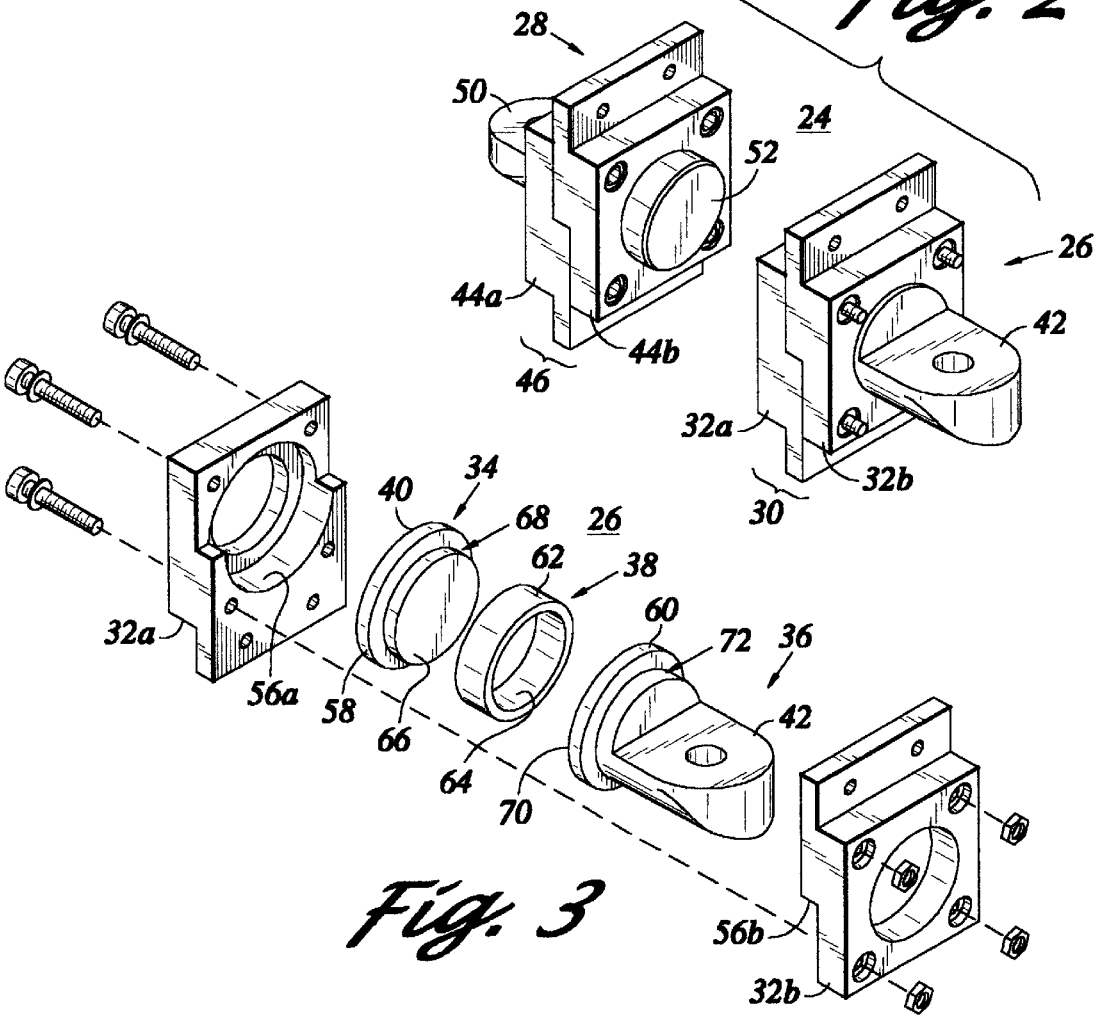
Fig. 3

BUTTON CONNECTOR WITH SAFE FRONT

FIELD OF THE INVENTION

The present invention relates generally to electrical connector sets, and more particularly a electrical connector set which includes first and second connectors with one of the connectors having a biasing member which breaks electrical contact when the first and second connectors are not engaged.

BACKGROUND OF THE INVENTION

Conventional pin and socket type connectors designed for rack and panel installation are prone to certain limitations which affect their mechanical usage and safety. In high power application they require a large diameter contact which must be accurately aligned in radial, depth and axial position to insure proper mating. The physical size of the contact can expose a significant amount of electrically charged surface area when the connector is not mated and power is applied. This exposure can be extremely hazardous to equipment or personnel coming into accidental contact with the charged surface. The male pins, which protrude significantly, are subject to mechanical breakage or bending from side loads. In addition, the pins are often sharp and present a safety hazard to persons who may be punctured by them.

It is therefore evident that there exists a need in the art for electrical connectors which mitigate the hazards of accidental electrical shock and physical injury, and the susceptibility to mechanical breakage.

SUMMARY OF THE INVENTION

In accordance with the present invention, there is provided a high power connector set which is provided with first and second connectors. The first and second connectors are adapted to be electrically connected to each other. The first connector itself comprises a first housing which is preferably formed of a material having relatively low electrical conductivity. The first housing preferably comprises identically configured first and second halves which are rigidly attached to each other through the advancement of fasteners such as screws through corresponding openings therein. In addition to the first housing, the first connector includes first and second contacts which are at least partially captured within the first housing. Disposed within the first housing between the first and second contacts is a resilient biasing member which normally maintains the first and second contacts in spaced relation to each other.

In the preferred embodiment, the first contact defines a circularly configured, substantially flat engagement surface which is recessed within the first housing, thus making the first connector a female-type connector. Additionally, the second contact includes an integral terminal portion which is adapted to be connectable to an electrical lead. The biasing member, which has an annular configuration, is preferably fabricated from an elastomer.

The second connector of the connector set comprises a second housing which itself comprises identically configured first and second halves which are formed of a material having low electrical conductivity and rigidly attached to each other. The first and second halves of the second housing are also identically configured to the first and second halves of the first housing. In addition to the second housing, the second connector includes a third contact which is at least partially captured within the second housing and includes an integral terminal portion. The third contact also defines a circularly configured, substantially flat engagement surface which protrudes from the second housing, thus making the second connector a male-type connector. The second connector further comprises a pair of resilient bushing members which extend between the third contact and the second housing. The bushing members, which are identically configured to each other and the biasing member, are also each preferably fabricated from an elastomer.

In the connector set of the present invention, the electrical connection of the first and second connectors to each other is facilitated by initially placing the engagement surface of the third contact of the movable second connector into axial alignment with the engagement surface of the first contact of the fixed or stationary first connector. Thereafter, the second connector is advanced toward the first connector such that the third contact, and in particular the engagement surface thereof, is received into the first housing and abutted against the engagement surface of the first contact. The advancement of the second connector toward the first connector is continued so as to cause the engagement surface of the third contact to apply pressure to the engagement surface of the first contact in an amount sufficient to compress the biasing member. Such compression of the biasing member in turn results in the electrically conductive engagement between the first and second contacts, and hence the electrical connection of the third contact to the second contact via the first contact.

Importantly, the bushing members of the second connector allow for the radial and/or axial movement of the third contact relative to the second housing to compensate for any misalignment between the engagement surfaces as the second connector is advanced toward the first connector and the engagement surfaces are brought into abutting contact with each other. In the second connector, the bushing members are slightly compressed between the third contact and the second housing, thus causing an outward biasing force to be exerted against the third contact. As such, in addition to compensating for misalignment, the bushing members cause constant pressure to be applied by the engagement surface of the third contact to the engagement surface of the first contact when the engagement surfaces are abutted against each other. The additional force or pressure applied to the engagement surface of the first contact by the engagement surface of the third contact attributable to the biasing force exerted by the bushing members further assists in the compression of the biasing member of the first connector.

The present invention represents an advancement in the art and mitigates the limitations associated with prior art connector designs.

Importantly, conventional connector set designs have the potential for electrical discharge when the connector set is unengaged. The present invention incorporates an important safety feature wherein the first connector (male) such that when the connector set is unengaged the electrical connection within the first connector is broken as facilitated by the biasing member. In addition, the first and third contacts, the exposed contacts, are preferably formed to be flat surfaces and thus present little threat of puncture injury.

Advantageously, in comparison to conventional pin and socket designs, the exposed first and third contacts have a relatively greater mechanical strength because of the flat and relatively low profile shape. Thus, the connector set of the present invention mitigates the propensity of mechanical breakage.

Significantly, the first and second connectors are designed to electrically mate without the necessity for precision connector alignment. This is facilitated by the utilization of the bushing members in the second housing which compensates for radial and/or axial misalignments of first and third contacts, the engaging contact surfaces.

Advantageously, many of the components are identical and are interchangeable. The first and second housings are identically formed. Likewise, the biasing members and the bushing members are all interchangeable. The overall assembly of the connector set is simple and straight forward. The connector set of the present invention may be assembled using standard hand tools, thus permitting field repairs as necessary. Wire connection can be created as desired for specific applications by simple machining of the rear of the second and third contacts.

Accordingly, the present invention represents a significant advance in the art.

BRIEF DESCRIPTION OF THE DRAWINGS

These, as well as other features of the present invention, will become more apparent upon reference to the drawings wherein:

FIG. 1 is a perspective view a conventional prior art pin and socket connector set;

FIG. 2 is perspective view of the present invention, illustration the first and second connectors thereof;

FIG. 3 is an exploded view of the first connector;

Detailed Description of the Preferred Embodiment

Figure 4:
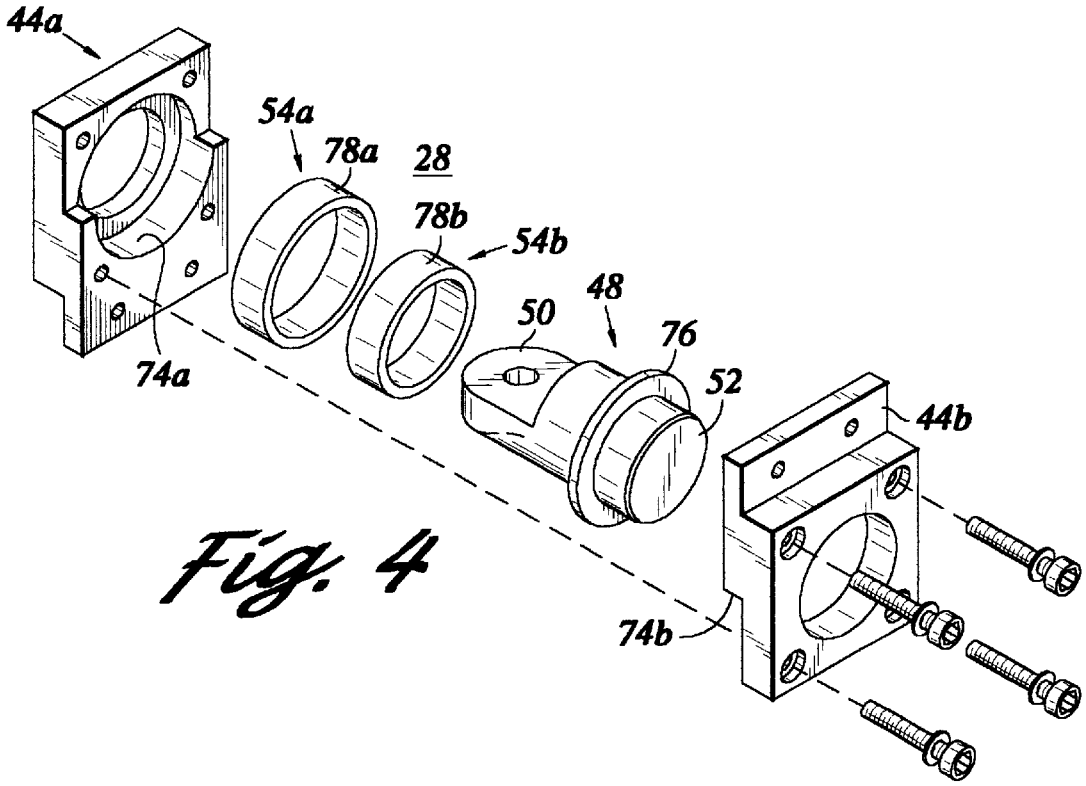
FIG. 4 is an exploded view of the second connector.
Figure 5:
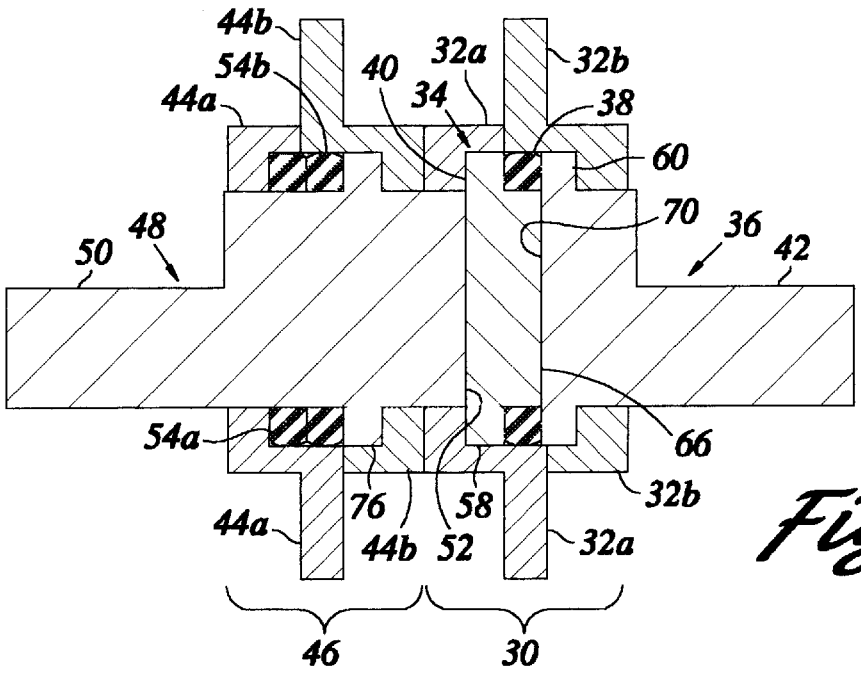
FIG. 5 is a cross sectional view of the present invention in its operable configuration.

Referring now to the drawings wherein the showings are for purposes of illustrating a preferred embodiment of the present invention only, and not for purposes of limiting the same, FIG. 1 illustrates a prior art pin and socket connector set and FIGS. 2–5 illustrate a electrical connector set which is constructed in accordance with the present invention.

Referring now to FIG. 1, there is shown a conventional pin and socket type connector set 10 as is known in the prior art. As is typical, there is provided a male connector 12 and a female connector 14. The male connector 12 includes multiple contact pins 16 and a pair of alignment pins 18. The female connector 14 is provided with multiple sockets 20 which are formed to receive the corresponding contact pins 16 of the male connector 12. In addition, there is provided a pair of alignment holes 22 which are formed to receive the corresponding alignment pins 18 of the male connector 12. The contact pins 16 and alignment pins 18 usually have sharp or pointed ends to facilitate insertion into the respective sockets 20 and alignment holes 22.

The alignment pins 18 are usually longer than the contact pins 16. As the alignment pins 18 are inserted into the alignment holes 22 of the female connector 14, the alignment pins 18 guide the subsequent insertion of the contact pins 16 into the corresponding sockets 20.

In practice, the female connector 14 is attached to a movable electrical panel or display, while the male connector 12 is attached to a relatively larger fixed rack or housing. Typically, the female connector 14 is electrically charged. A significant hazard of exposure to a significant amount of electrically charged surface area is present when power is applied to an unmated female connector 14. The hazard is especially present where the diameter of the sockets 20 is sufficient to allow direct contract with a conductive surface, such as a person's finger tip.

In addition, the pointed-end nature of the contact and alignment pins 16, 18 present a safety hazard to persons who may be punctured by them. Significantly, the male pins 16 are susceptible to mechanical breakage or bending from side loads due to their elongate protruding shape. Thus, a conventional pin and socket type connector set 10 is prone to many limitations which affect their mechanical usage and safety.

In accordance with the present invention, as illustrated in FIGS. 2–5, there is provided a connector set 24 which is provided with first and second connectors 26, 28. The first and second connectors 26, 28 are adapted to be electrically connected to each other. The first connector 26 itself comprises a first housing 30 which is preferably formed of a material having relatively low electrical conductivity, such as plastic or resin for example. The first housing 30 preferably comprises identically configured first and second halves 32*a*, 32*b* which are rigidly attached to each other through the advancement of fasteners such as screws through corresponding openings therein. In addition to the first housing 30, the first connector 26 includes first and second contacts 34, 36 which are at least partially captured within the first housing 30. Disposed within the first housing 30 between the first and second contacts 34, 36 is a resilient biasing member 38 which normally maintains the first and second contacts 34, 36 in spaced relation to each other.

In the preferred embodiment, as depicted in an exploded assembly view in FIG. 3, the first contact 34 defines a circularly configured, substantially flat engagement surface 40 which is recessed within the first housing 30, thus making the first connector 26 a female-type connector. Additionally, the second contact 36 includes an integral terminal portion 42 which is adapted to be connectable to an electrical lead, not shown. Preferably, the biasing member 38 has an annular configuration and is fabricated from an elastomer. One of ordinary skill in the art will recognize that the biasing member 38 may have other configurations, such as a spring shape, and may be formed of other well known materials.

As previously noted, the first and second halves 32*a*, 32*b* of the first housing 30 are identical, and are thus interchangeable. The first and second halves 32*a*, 32*b* may be formed of a material having low electrical conductivity and are rigidly attached to each other. When assembled, the first and second halves 32*a*, 32*b* are oriented such that they appear to be mirror images of each other rotated by 180 degrees. The material selection and method of attachment of the first and second halves 32*a*, 32*b* are contemplated to be chosen from those well known to one of ordinary skill in the art.

The first and second halves 32*a*, 32*b* are each provided with respective semi-circular shoulder portions 56*a*, 56*b*. Upon assembly of the first and second halves 32*a*, 32*b*, the semi-circular shoulder portions 56*a*, 56*b* collectively define an cylindrical interior of the first housing 30, within which the first contact 34, biasing member 38 and second contact 36 are captured. The first and second contacts 34, 36 are provided with respective circumferential flange portions 58, 60 of identical radial dimensions. The biasing member 38 is provided with an outer portion 62 which is sized and configured to have a radial dimension identical to the flange portions 58, 60 of the first and second contact 34, 36. The identical radial dimensions of the flange portions 58, 60 of the first and second contacts 34, 36 and the outer portion 62 biasing member 38 are sized and configured such that the first contact 34, biasing member 38 and second contact 36 abut the shoulder portions 56*a*, 56*b* of the assembled first and second halves 32*a*, 32*b*. Thus, through this circumferential abutting engagement, the shoulder portions 56*a,* 56*b* cooperatively maintain axial alignment of the first contact 34, biasing member 38 and second contact 36.

The first contact 34 is provided with an internal surface 66 which is configured in opposing orientation to the engagement surface 40 with the flange portion 58 disposed therebetween. A circular shoulder portion 68 is formed between the flange portion 58 and the internal surface 66. Similarly, the second contact 36 is provided with an internal surface 70 which is configured in opposing orientation to the terminal portion 42 with the flange portion 60 disposed therebetween. A circular shoulder portion 72 is formed between the flange portion 60 and the internal surface 66. Shoulder portions 68, 72 are identically sized. The biasing member 38 is additionally provided with an inner portion 64 which is sized and configured is radially received the shoulder portion 68 of the first contact 34. The engagement between the inner portion 64 of the biasing member 38 and the respective shoulder portion 68 of the first contact 34 additionally facilitates radial and axial alignment of the first contact 34 with respect to second contact 36.

One of ordinary skill in the art will readily recognize that the first connector 26 may be easily assembled as the shapes of the components parts are designed to cooperatively engage each other as especially facilitated by the shoulder portions 56*a,* 56*b* of the assembled first and second halves 32*a,* 32*b* and the shoulder portions 68, 72 of the first and second contact 34, 36.

Referring now to FIG. 4, the second connector 28 of the connector set 10 comprises a second housing 46 which itself comprises identically configured first and second halves 44*a,* 44*b*. The first and second halves 44*a,* 44*b* of the second housing 46 are also identically configured to the first and second halves 32*a,* 32*b* of the first housing 30, thus making these component parts interchangeable.

Like the first and second halves 32*a,* 32*b* of the first housing 30, the first and second halves 44*a,* 44*b* of the second housing 46 may be formed of a material having low electrical conductivity. The material selection and method of attachment for these interchangeable components are contemplated to be chosen from those well known to one of ordinary skill in the art.

In addition to the second housing 46, the second connector 28 includes a third contact 48 which is at least partially captured within the second housing 46 and includes an integral terminal portion 50. The third contact 48 also defines a circularly configured, substantially flat engagement surface 52 which protrudes from the second housing 46, thus making the second connector 28 a male-type connector. The second connector 28 further comprises a pair of resilient bushing members 54*a,* 54*b* which extend between the third contact 48 and the second housing 46. In the preferred embodiment of the present invention, the bushing members 54*a,* 54*b,* are identically configured to each other and the biasing member 38, thus making these component parts interchangeable. The bushing members 54*a,* 54*b,* are fabricated from an elastomer, although one of ordinary skill in the art will recognize that other suitable materials are well known in the art.

In the connector set 24 of the present invention, the electrical connection of the first and second connectors 26, 28 to each other is facilitated by initially placing the engagement surface 52 of the third contact 48 of the movable second connector 28 into axial alignment with the engagement surface 40 of the first contact 34 of the fixed or stationary first connector 26. Thereafter, the second connector 28 is advanced toward the first connector 26 such that the third contact 48, and in particular the engagement surface 52 thereof, is received into the first housing 30 and abutted against the engagement surface 40 of the first contact 34. The advancement of the second connector 28 toward the first connector 26 is continued so as to cause the engagement surface 52 of the third contact 48 to apply pressure to the engagement surface 40 of the first contact 34 in an amount sufficient to compress the biasing member 38 as depicted in the cross sectional view of the connector set 24 in FIG. 5. Such compression of the biasing member 38 in turn results in the electrically conductive engagement between the first and second contacts 34, 36, and hence the electrical connection of the third contact 48 to the second contact 36 via the first contact 34.

The first and second halves 44*a,* 44*b* are each provided with respective semi-circular shoulder portions 74*a,* 74*b*. Upon assembly of the first and second halves 44*a,* 44*b,* the semi-circular shoulder portions 74*a,* 74*b* collectively define an cylindrical interior of the second housing 46, within which the third contact 48 and bushing members 54*a,* 54*b* are captured. The third contact 48 is provided with a circumferential flange portions 76. The bushing members 54*a,* 54*b* are provided with respective outer portions 78*a,* 78*b* which are sized and configured to have a radial dimension identical to the flange portion 76 of the third contact 48. The identical radial dimensions of the flange portion 76 of the third contact 48 and the outer portions 78*a,* 78*b* of the bushing members 54*a,* 54*b* are sized and configured such that the third contact 48 and the bushing members 54*a,* 54*b* abut the shoulder portions 74*a,* 74*b* of the assembled first and second halves 44*a,* 44*b*. Thus, through this circumferential abutting engagement, the shoulder portions 74*a,* 74*b* cooperatively maintain axial alignment of the third contact 48 and the bushing members 54*a,* 54*b*. One of ordinary skill in the art will readily recognize that the second connector 28, like the first connector 26, may be easily assembled as the shapes of the components parts are designed to cooperatively engage each other as especially facilitated by the shoulder portions 74*a,* 74*b* of the assembled first and second halves 44*a,* 44*b*.

Importantly, the bushing members 54*a,* 54*b* of the second connector 28 allow for the radial and/or axial movement of the third contact 48 relative to the second housing 46 to compensate for any misalignment between the engagement surfaces 40, 52 as the second connector 28 is advanced toward the first connector 26 and the engagement surfaces 40, 52 are brought into abutting contact with each other. In the second connector 28, the bushing members 54*a,* 54*b* are slightly compressed between the second housing 46 and the flange portion 76 of the third contact 48, thus causing an outward biasing force to be exerted against the third contact 48 in the direction of the engagement surface 52. As such, in addition to compensating for misalignment, the bushing members 54*a,* 54*b* cause constant pressure to be applied by the engagement surface 52 of the third contact 48 to the engagement surface 40 of the first contact 34 when the engagement surfaces 40, 52 are abutted against each other. The additional force or pressure applied to the engagement surface 40 of the first contact 34 by the engagement surface 52 of the third contact 48 attributable to the biasing force exerted by the bushing members 54*a,* 54*b* further assists in the compression of the biasing member 38 of the first connector 26.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A connector set, comprising:

a first connector comprising:

a first housing comprising identically configured first and second halves which are attached to each other;

first and second contacts at least partially captured within the first housing; and a resilient biasing member disposed within the first housing and normally maintaining the first and second contacts in spaced relation to each other;

a second connector comprising:

a second housing comprising identically configured first and second halves which are attached to each other, the first and second halves of the second housing being identically configured to the first and second halves of the first housing; and a third contact at least partially captured within the second housing;

wherein the application of pressure to the first contact by the third contact in an amount sufficient to compress the biasing member results in the electrically conductive engagement between the first and second contacts and the electrical connection of the third contact to the second contact, with the removal of pressure from the first contact resulting in the resilient return of the biasing member to an uncompressed state which separates the first and second contacts from each other and breaks the electrical connection between the third and second contacts.

2. The connector set of claim 1 wherein the first and third contacts each define a substantially flat engagement surface, the application of pressure to the first contact by the third contact being facilitated by the abutment of the engagement surfaces against each other.

3. The connector set of claim 2 wherein the engagement surface of the first contact is recessed within the first housing and the engagement surface of the third contact protrudes from the second housing, said third contact being partially received into the first housing to facilitate the abutment of the engagement surfaces against each other.

4. The connector set of claim 3 wherein the engagement surfaces have generally circular configurations, and the second connector further comprises:

at least one resilient bushing member extending between the third contact and the second housing;

said bushing member allowing for the radial and axial movement of the third contact relative to the second housing to compensate for any misalignment between the engagement surfaces, and causing constant pressure to be applied by the engagement surface of the third contact to the engagement surface of the first contact when the engagement surfaces are abutted against each other.

5. The connector set of claim 4 wherein the second connector includes a pair of bushing members extending between the third contact and the second housing.

6. The connector set of claim 5 wherein the bushing members and the biasing member are identically configured and each fabricated from an elastomer.

7. The connector set of claim 1 wherein the second and third contacts each include a terminal portion.

8. A connector set, comprising:

a first connector comprising a first housing, first and second contacts at least partially captured within the first housing, and a resilient biasing member disposed within the first housing and normally maintaining the first and second contacts in spaced relation to each other, the first contact defining a substantially flat and generally circular engagement surface recessed within the first housing;

a second connector comprising a second housing, a third contact at least partially captured within the second housing, and at least one resilient bushing member extending between the third contact and the second housing, the third contact defining a substantially flat and generally circular engagement surface protruded from the second housing, the third contact being partially received into the first housing to facilitate abutment of the engagement surfaces of the first and third contacts against each other;

wherein the application of pressure to the first contact by the third contact in an amount sufficient to compress the biasing member results in the electrically conductive engagement between the first and second contacts and the electrical connection of the third contact to the second contact, the application of pressure to the first contact by the third contact being facilitated by the abutment of the engagement surfaces against each other, with the removal of pressure from the first contact resulting in the resilient return of the biasing member to an uncompressed state which separates the first and second contacts from each other and breaks the electrical connection between the third and second contacts, the bushing member allowing for the radial and axial movement of the third contact relative to the second housing to compensate for any misalignment between the engagement surfaces, and causing constant pressure to be applied by the engagement surface of the third contact to the engagement surfaces of the first contact when the engagement surfaces are abutted against each other.

9. The connector set of claim 8 wherein the second connector includes a pair of bushing members extending between the third contact and the second housing.

10. The connector set of claim 9 wherein the bushing members and the biasing member are identically configured and each fabricated from an elastomer.

11. The connector set of claim 8 wherein:

the first housing comprises identically configured first and second halves which are attached to each other; and the second housing comprises identically configured first and second halves which are attached to each other;

the first and second halves of the first housing being identically configured to the first and second halves of the second housing.

12. The connector set of claim 8 wherein the second and third contacts each include a terminal portion.

* * * * *

UNITED STATES PATENT AND TRADEMARK OFFICE

CERTIFICATE OF CORRECTION

PATENT NO. : 5,971,783
DATED : October 26, 1999
INVENTOR(S) : Karl Edward Mann

It is certified that error appears in the above-identified patent and that said Letters Patent is hereby corrected as shown below:

Column 1,
Line 2, before the "FIELD OF THE INVENTION", please insert the following:

-- STATEMENT RE: FEDERALLY SPONSORED RESEARCH/DEVELOPMENT
This invention was made with Government support under N00019-97-C-0147 awarded by the Department of the Navy. The Government has certain rights in this invention. --

Signed and Sealed this

Seventeenth Day of June, 2003

JAMES E. ROGAN
*Director of the United States Patent and Trademark Office*